United States Patent [19]
Alter et al.
[11] 4,317,538
[45] Mar. 2, 1982

[54] ENVELOPE

[76] Inventors: Seymour S. Alter, 31 Brianfield Dr., Great Neck, N.Y. 11020; Steven Alter, 265 W. 11th St., New York, N.Y. 10014

[21] Appl. No.: 938,057

[22] Filed: Aug. 30, 1978

[51] Int. Cl.[3] ..... B65D 27/08
[52] U.S. Cl. ..... 229/72
[58] Field of Search ..... 229/69, 72; 282/25

[56] References Cited

U.S. PATENT DOCUMENTS

| | | | |
|---|---|---|---|
| 693,624 | 2/1902 | Sallade | 229/69 |
| 1,013,571 | 1/1912 | Stevens | 229/69 |
| 1,163,459 | 12/1915 | Rheutan | 229/69 |
| 2,001,489 | 5/1935 | Elbaum | 229/72 |
| 2,196,461 | 4/1940 | Heywood | 282/25 |
| 3,343,749 | 9/1967 | Probst | 229/72 |
| 3,863,836 | 2/1975 | Austin | 282/25 |
| 4,072,264 | 2/1978 | Kranz | 229/72 |

FOREIGN PATENT DOCUMENTS

| | | | |
|---|---|---|---|
| 226938 | 5/1943 | Switzerland | 282/25 |

*Primary Examiner*—Stephen P. Garbe
*Attorney, Agent, or Firm*—Kane, Dalsimer, Kane, Sullivan and Kurucz

[57] ABSTRACT

A multiple compartment envelope is provided with each envelope adapted to carry identical information on their respective exteriors with a single writing. The envelopes are joined along their longitudinal edges and perforated along the joint for easy separation. Each envelope includes a flap with an appropriate adhesive for sealing purposes. After the user has deposited the desired contents into each envelope, one of the flaps may be folded to close the first envelope. This envelope is then folded along the perforated joint so that it lies above the other envelope. The flap of the other envelope is provided with a backing of carbon paper. This flap is folded over so that it contacts the back of the first envelope. Information written upon the flap will accordingly be carried upon both envelopes with a single writing. The envelopes may then be unfolded and sealed with the flaps. They are then separated along the perforation. An integral blank for forming the multiple compartment envelope is also disclosed.

4 Claims, 6 Drawing Figures

FIG. 4
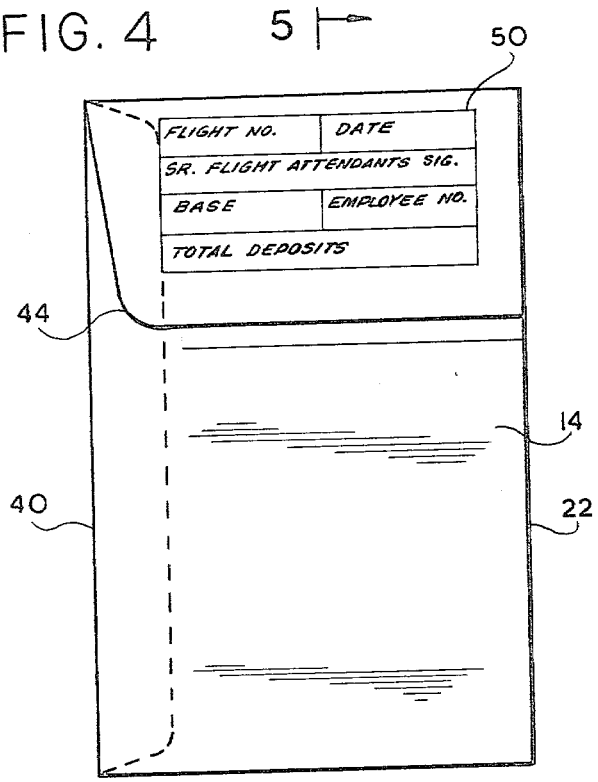
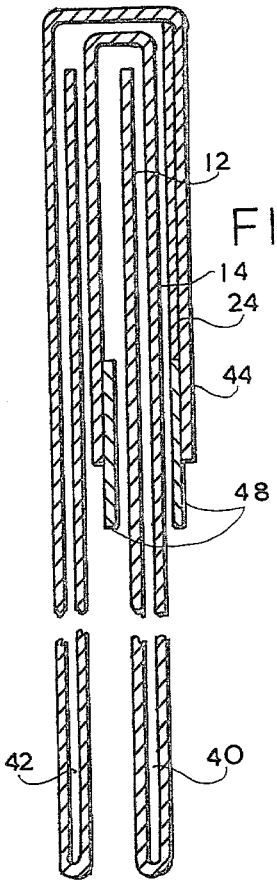
FIG. 5
FIG. 6
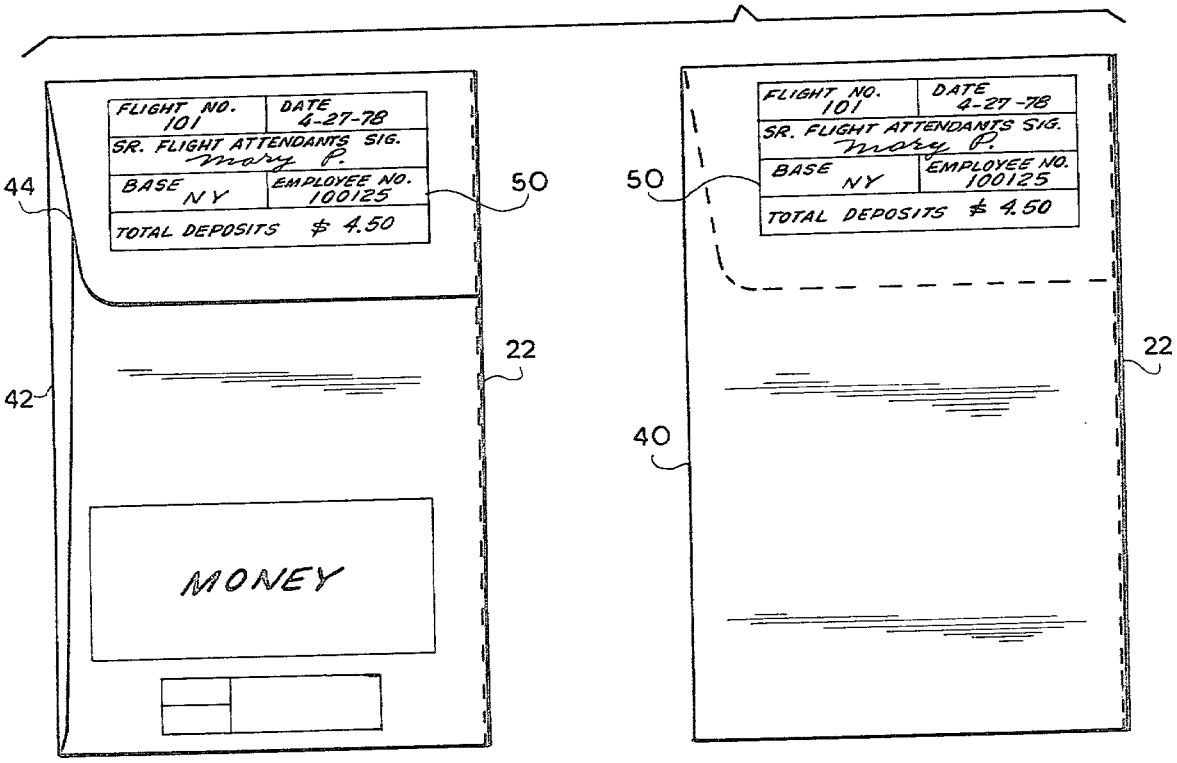

ENVELOPE

BACKGROUND OF THE INVENTION

The field of the invention relates to envelopes having means by which information can be provided on at least two envelopes with a single writing.

In many transactions, it is necessary to send information concerning the same transaction to different departments within a business or corporation. One example is in the sale of liquor aboard an aircraft. When a bottle is sold, cash is collected and a seal from the bottle is removed. The cash should be placed in one envelope, the seal in another, and the respective envelopes transmitted to the appropriate departments. Each envelope should contain information concerning the details of the transaction such as the flight number on which it was conducted, the employee who made the sale, and any other pertinent material.

Many other transactions involve the collection of different copies, cash and vouchers, or different forms which are expected to go to various departments. It is inconvenient and time-consuming, however, to write all the necessary details on two or more separate envelopes when transmitting information to a number of departments.

SUMMARY OF THE INVENTION

With the above-stated background in mind, it is among the objects of the invention to provide an envelope having means by which identical information can be carried upon a plurality of envelopes with a single writing.

Another object of the invention is to provide an envelope which allows a carbon copy of information to be made upon another envelope without the danger of getting carbon on other papers.

Still another object of the invention is to provide an envelope having two detachable carrying compartments which can be used to transmit information to different departments of a business.

These and other objectives are accomplished by the provision of an envelope comprising a pocket or compartment for holding a desired material, a flap for closing an opening within the pocket or compartment, and a backing of carbon or other suitable substance on the back of flap. For maximum convenience and efficiency, a second envelope can be detachably secured to the one having the carbon-backed flap. The second envelope may be folded so that it lies upon the first envelope, whereupon the carbon-backed flap can be folded to rest upon the second envelope. Information written upon the flap will accordingly be transmitted to the second envelope.

After the necessary information is recorded on the two envelopes, they may be detached and sent to the appropriate departments. Because the back of the flap is provided with a carbon surface, the sealing of the envelope by closing the flap prevents carbon from being deposited on any other papers.

To facilitate the detachment of one envelope from another, perforations may be provided between the two envelopes. Since the envelopes carry identical information, forms may be provided on both envelopes such that a form printed on the carbon-backed flap will overlie the same form printed on the second envelope. The user will accordingly fill out both forms simultaneously.

BRIEF DESCRIPTION OF THE DRAWINGS

FIG. 4 shows the reverse side of one of the envelopes illustrated in FIG. 3 which is folded upon the other envelope;

FIG. 5 is an enlarged sectional view taken along section line 5—5 of FIG. 4;

FIG. 6 shows two envelopes which have been detached from one another after information is recorded on both.

DETAILED DESCRIPTION OF THE INVENTION

Figure 1:
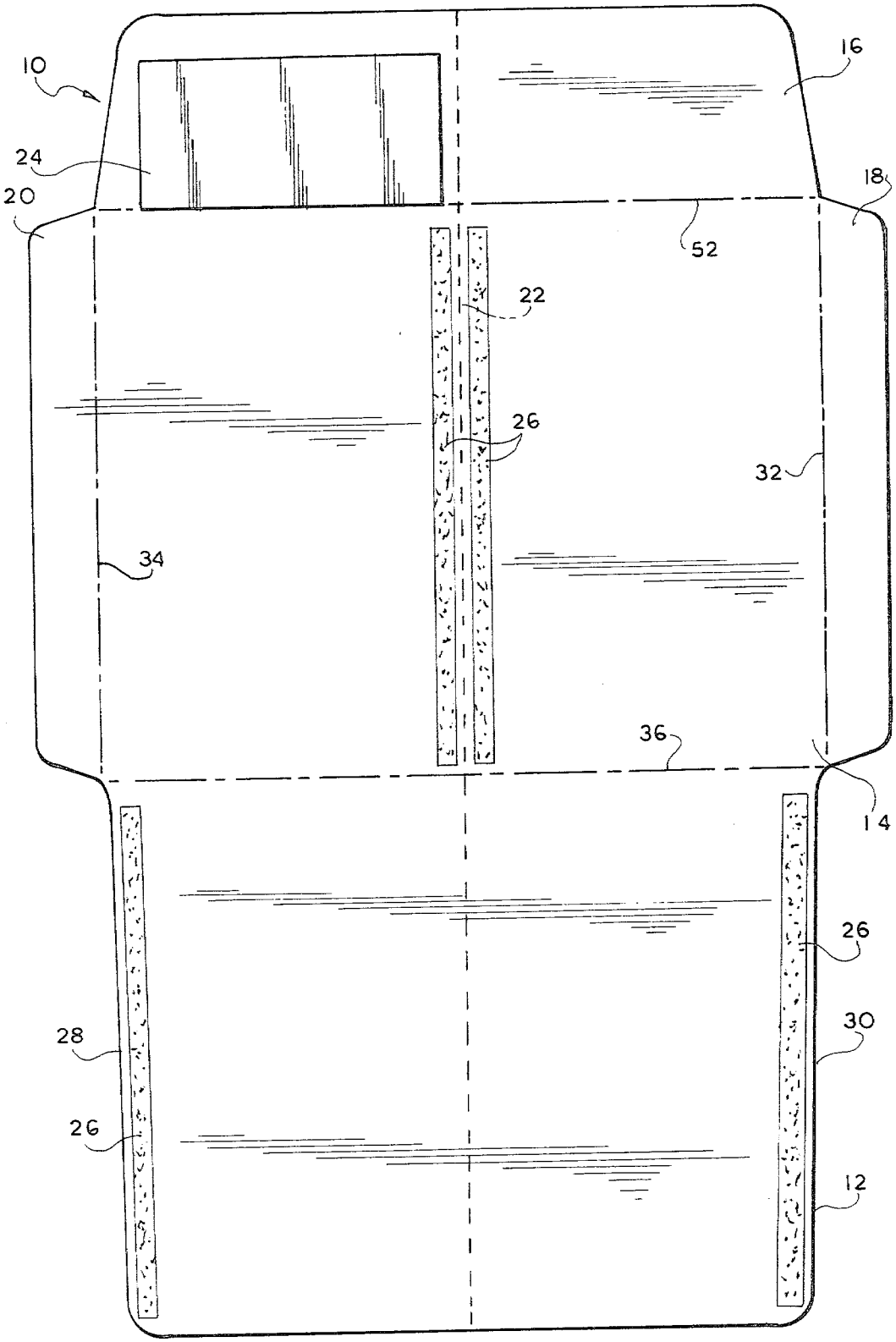
FIG. 1 is a plan view of a form which can be folded and glued into a double envelope.

FIG. 1 illustrates a one-piece unitary paper blank 10 prior to its assembly into a double envelope as shown in FIGS. 2-6. The blank includes a first section 12 having longitudinally spaced top and bottom edges and transversely spaced right and left side edges which will become the front panels of the double envelope. A second section 14, having a similar shape as the first section, later becomes the rear panels of the envelopes. The bottom of the second section is integral with the top of the first section. The bottom edge of flap 16 is joined to the top edge of the second section 14, and flaps 18 and 20 are joined to the side edges of the second section. The center of the blank 10 is divided by a perforated line 22 which runs through sections 12, 14 and 16, respectively approximately midway between the sides. A carbon backing 24 is provided on the rear surface of the top flap 16. Other backings equivalent to carbon may alternatively be employed.

Figure 2:
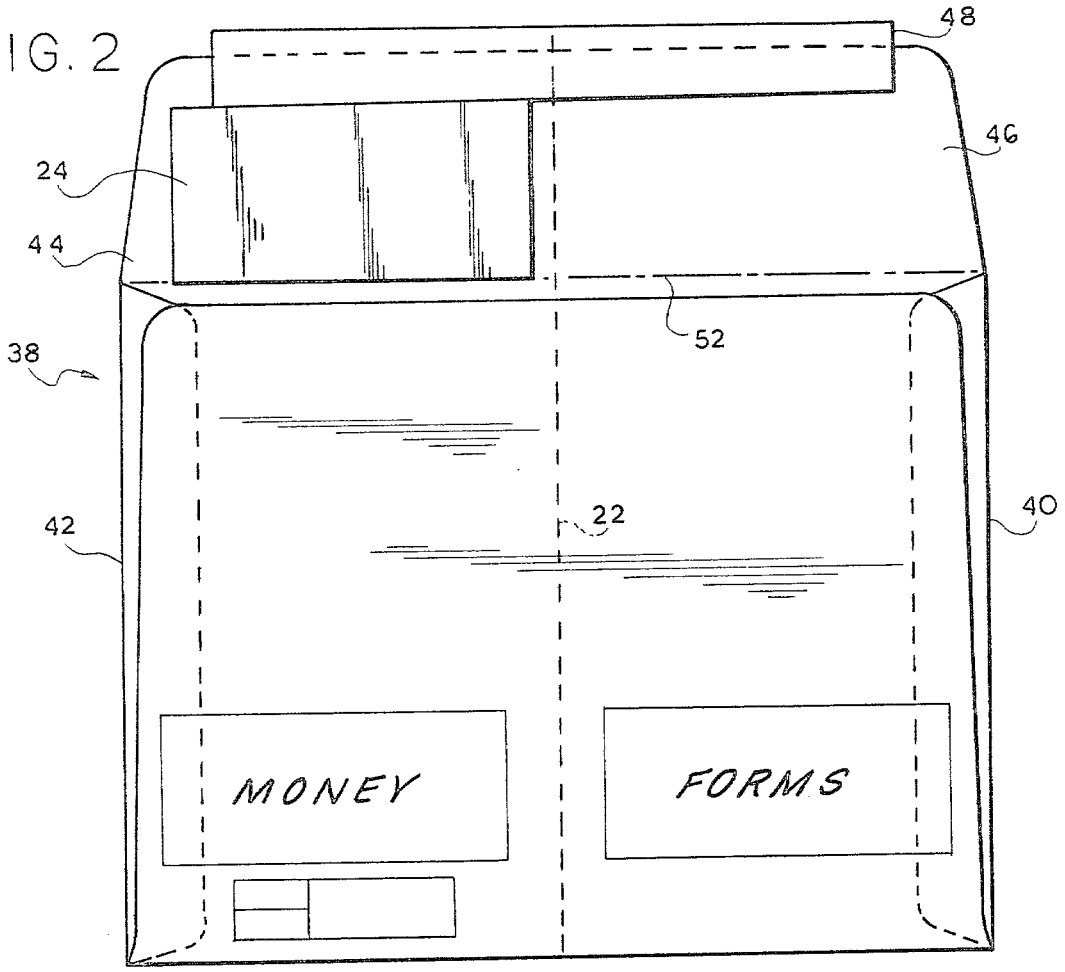
FIG. 2 is a plan view of a double envelope in which the flaps of both envelopes are open.

The double envelope is formed by applying strips of glue 26 along both sides of the perforations 22 in the second section 14. Strips of glue 26 are also provided near the side edges 28, 30 of the first section 12. The flaps 18, 20 on either side of section 14 are folded along fold lines 32, 34 respectively. The first section 12 is then folded along fold line 26 whereupon the flue 26 seals it to section 14. A double envelope 38 as illustrated in FIG. 2 in thereby provided. Alternatively, the sections 12 and 14 may be gummed together to form pockets without employing the flaps 18, 20.

Figure 3:
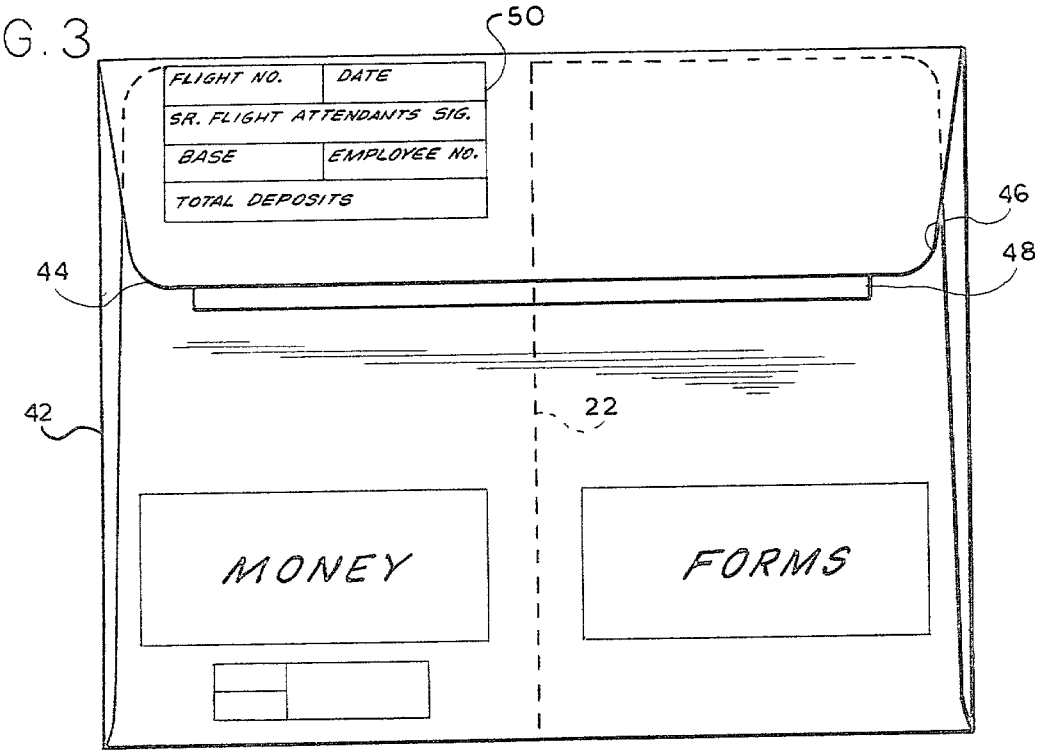
FIG. 3 is a plan view of a double envelope wherein the flaps are closed but not sealed.

The envelope 38 comprises two compartments 40 and 42, one of which may be used for cash and the other for forms. The compartments are separated by the perforated line 22 along their longitudinal edges. Each compartment has a flap 44 or 46 for sealing it. Tape 48 is placed over a self-sticking adhesive on each flap, and is removed when the compartments are to be sealed. Ordinary remoistening gum, as is found on most commercial envelopes, can be used in lieu of the self-sticking gum with the peel-off protective tape. Each compartment may be labelled to indicate the contents it is to receive. As illustrated in FIG. 3, the flap 44 of one envelope compartment 42 includes a printed form 50 which is to be filled out when a transaction is made.

FIG. 4 shows the reverse side of compartment 40 as it is folded along the perforations 22. An identical form 50 is printed towards the top of this reverse side. The flap 44 of the other compartment 42 is folded over this form. FIG. 5 is a sectional view along line 5—5 of FIG.

4 illustrating the layers of the double envelope. It is exaggerated in size for purposes of illustration of its use.

The double envelope 38 is utilized by first separating the two flaps 44 and 46 along the perforations 22. The flap 46 which does not have the carbon backing is then folded along fold line 52 so that it lies against the front panel 12 of compartment 40. The compartment 40 is then folded along the perforated line 22 so that it lies upon the other compartment 42. The back panel 14 of the folded compartment will accordingly face upwardly with the printed form 50 thereon. The carbon-backed flap 44 is folded along line 52 such that it lies upon the back panel 14 of compartment 40. In this position, the printed form 50 on the flap 44 directly overlies the form 50 on said back panel 14. When information is written on the form on the flap 44, it will automatically be carried in the appropriate location on the other compartment 40. The term "written" is intended to include any method of providing information, such as typing, stamping, or other procedures.

The flap 44 is then reopened and the compartments 40, 42 opened along the perforated line 22 so that the double envelope again takes the form shown in FIG. 2. After the appropriate material is inserted within each compartment, the tape 48 is removed from each flap 44, 46. The compartments are sealed and can be easily separated by tearing across the perforations 22. Two separate compartments or envelopes are accordingly produced as shown in FIG. 6. Each carries identical information concerning a transaction on its exterior surface. In one compartment 42, the information is carried on the flap 44. In the other, the information is carried on the back panel 14. Because the carbon is positioned on the inside portion of the flap 44, it will not smear over other papers when the compartment 42 is closed.

It will be appreciated by those skilled in the art that other constructions of the envelope may be possible without departing from the spirit of the invention. The compartments may be secured to each other along different edges or the carbon backing may be in another location. Other modifications are also envisioned. The scope of the invention should accordingly be determined in light of the appended claims.

What is claimed is:

1. A multiple-compartment envelope comprising a first compartment having an opening and a flap adapted for closing said opening, said flap having a backing of a material suitable for copying information written on said flap to an article placed therebelow, and a second compartment detachably secured to said first compartment, said second compartment being able to be folded under the flap of the first compartment so that information provided on said flap will be copied upon said second compartment, said flap including a form printed thereon opposite the backing, and the second compartment including a form substantially identical to the form printed on the flap, the forms being positioned such that when the second compartment is folded under the flap, the form on the flap overlies the form on the second compartment.

2. An envelope as described in claim 1 wherein said flap has a carbon backing.

3. An envelope as described in claim 1 wherein said compartments are secured to each other along longitudinal edges.

4. An envelope as described in claim 1 wherein said second compartment includes an opening and a flap adapted for closing said opening.

* * * * *